US010049546B2

(12) United States Patent
Wu et al.

(10) Patent No.: US 10,049,546 B2
(45) Date of Patent: Aug. 14, 2018

(54) ANTI-THEFT SYSTEM, ANTI-THEFT DEVICE AND ANTI-THEFT METHOD

(71) Applicants: QUASION INC., Ontario (CA); Xiaohua Wu, Beijing (CN)

(72) Inventors: Xiaohua Wu, Beijing (CN); Huosheng Hu, Colchester (GB); Ian Dukes, Essex (GB); Xiaolong Li, Beijing (CN); Ziyue Ouyang, Beijing (CN)

(73) Assignees: QUASION INC., Ancaster, CA (US); Xiaohua Wu, Beijing (CN)

( * ) Notice: Subject to any disclaimer, the term of this patent is extended or adjusted under 35 U.S.C. 154(b) by 0 days.

(21) Appl. No.: 15/115,266

(22) PCT Filed: Jan. 29, 2014

(86) PCT No.: PCT/CN2014/071797

§ 371 (c)(1),
(2) Date: Jul. 29, 2016

(87) PCT Pub. No.: WO2015/113271

PCT Pub. Date: Aug. 6, 2015

(65) Prior Publication Data

US 2017/0004690 A1 Jan. 5, 2017

(51) Int. Cl.
*G08B 13/24* (2006.01)
*G08B 7/06* (2006.01)
(Continued)

(52) U.S. Cl.
CPC ..... *G08B 13/2431* (2013.01); *G08B 7/06* (2013.01); *G08B 13/1427* (2013.01);
(Continued)

(58) Field of Classification Search
None
See application file for complete search history.

(56) References Cited

U.S. PATENT DOCUMENTS 4,337,462 A 6/1982 Lemelson
7,305,714 B2 12/2007 Hamaguchi et al.
(Continued)

FOREIGN PATENT DOCUMENTS

JP 09198575 7/1997
JP 2006309527 11/2006
(Continued)

OTHER PUBLICATIONS

Extended European Search Report dated Oct. 5, 2017 for EP Appl. No. 14881280.3.

*Primary Examiner* — Leon-Viet Nguyen
(74) *Attorney, Agent, or Firm* — Chieh-Mei Wang

(57) ABSTRACT

An anti-theft system includes at least one MEMS module, a master controlling module and an alerting module. The MEMS module is used for detecting a velocity, an acceleration and/or a spatial location of the MEMS module, and transferring the detected velocity, the acceleration or the spatial location of the MEMS module to the master controlling module. The master controlling module is used for determining whether the MEMS module is disposed within an anti-theft range according to the velocity, the acceleration or the spatial location of the MEMS module, and sending an alerting signal to the alerting module once the MEMS module is determined to be disposed outside of the anti-theft range. The alerting module is used for performing an alerting action when receiving the alerting signal. An anti-theft device and an anti-theft method are also provided.

11 Claims, 11 Drawing Sheets

(51) Int. Cl.
*G08B 21/24* (2006.01)
*G08B 13/14* (2006.01)
*G08B 25/00* (2006.01)

(52) U.S. Cl.
CPC ..... *G08B 13/1436* (2013.01); *G08B 13/2462* (2013.01); *G08B 21/24* (2013.01); *G08B 25/008* (2013.01)

(56) References Cited

U.S. PATENT DOCUMENTS

| | | | | |
|---|---|---|---|---|
| 8,702,516 | B2 * | 4/2014 | Bentley | H04N 7/18 463/39 |
| 2009/0171585 | A1 * | 7/2009 | Hoshizaki | G01C 21/16 701/480 |
| 2010/0032332 | A1 | 2/2010 | Davis et al. | |
| 2010/0033329 | A1 | 2/2010 | Davis et al. | |
| 2012/0133530 | A1 * | 5/2012 | Morgan | B60R 25/04 340/989 |
| 2015/0170496 | A1 * | 6/2015 | King | G08B 21/24 340/686.6 |

FOREIGN PATENT DOCUMENTS

| | | |
|---|---|---|
| JP | 2012164189 | 8/2012 |
| JP | 2013061692 | 4/2013 |
| WO | 2006057804 | 6/2006 |

* cited by examiner

ANTI-THEFT SYSTEM, ANTI-THEFT DEVICE AND ANTI-THEFT METHOD

FIELD OF THE INVENTION

The invention relates to an anti-theft system, and more particularly to an anti-theft system, an anti-theft device and an anti-theft method.

BACKGROUND OF THE INVENTION

Accompanying with improvement in people's material standard of living style, many people become more and more concerned about the security issues of family members and personal properties. However, commercial anti-theft systems or anti-theft devices often require a special configuration of network or a dedicated wiring, and thus, they are often disadvantageous in their complex configurations, expensive costs and limited ranges in application. Along with the rise, development and maturity in technologies of the Internet and micro electro-mechanical systems (MEMS), the development of anti-theft technology proceeds in a trend of a greater precision, miniaturization, easy operability and high portability.

MEMS technology is an advanced field of technology involving the principles of the micro-electronic technology and multidisciplinary sciences. With a four-decade-long development, it has become a crucial technology field in the world. MEMS sensors are a new type of sensor which is manufactured by utilizing the micro-electronic and micro-mechanical technologies. In comparison with a conventional sensor, a MEMS sensor is characterized by its small size, light weight, low cost, low power consumption, high reliability, suitability for batch-manufacturing, capability to integrate and intelligentize.

SUMMARY OF THE INVENTION

An objective of the present invention is to solve the issues of complex configuration in existing anti-theft devices and complex connection between the anti-theft devices and the objects to be protected.

In order to solve the above technical issues, the present invention provides an anti-theft system, which includes at least one micro electro-mechanical (MEMS) sensing module, a master controlling module and at least one alerting module. The MEMS sensing module is configured for detecting a velocity, an acceleration and/or a spatial location of the MEMS sensing module itself, and transferring the detected velocity, the acceleration or the spatial location of the MEMS sensing module to the master controlling module. The master controlling module is configured for determining whether the MEMS sensing module is disposed within an anti-theft range according to the velocity, the acceleration or the spatial location of the MEMS sensing module as transferred from the MEMS sensing module, and sending an alerting signal to the alerting module once the MEMS sensing module is determined to be disposed outside of the anti-theft range; wherein the anti-theft range is at least one of a velocity range, an acceleration range and a spatial range, or a combination of at least two thereof. The alerting module is configured for performing an alerting action when receiving the alerting signal.

In an embodiment of the present invention, each of the MEMS sensing module is integrated into a MEMS sensing device, the master controlling module is integrated into a master controlling device, and each of the MEMS sensing module communicates with the master controlling module wirelessly.

In an embodiment of the present invention, the master controlling module is configured for storing and defining a velocity, an acceleration and/or a spatial location of the anti-theft range, and determining whether the MEMS sensing module is disposed within the anti-theft range according to the velocity, the acceleration or the spatial location of the anti-theft range and the velocity, the acceleration or the spatial location of the MEMS sensing module.

In an embodiment of the present invention, the master controlling module is configured for receiving a defined velocity, a defined acceleration or a defined spatial location of the anti-theft range from an external element.

In an embodiment of the present invention, a current velocity, a current acceleration or a current spatial location of the MEMS sensing module is transferred to the master controlling module when the MEMS sensing module is disposed at the defined velocity, the defined acceleration or the defined spatial location of the anti-theft range. The master controlling module stores the current velocity, the current acceleration or the current spatial location of the MEMS sensing module as the defined velocity, the defined acceleration or the defined spatial location of the anti-theft range.

In an embodiment of the present invention, the master controlling module includes a storing unit and a determining unit. The storing unit is configured for storing the defined velocity, the defined acceleration or the defined spatial location of the anti-theft range. The determining unit is configured for determining whether the MEMS sensing module is disposed within the anti-theft range according to the defined velocity, the defined acceleration or the defined spatial location of the anti-theft range and the velocity, the acceleration or the spatial location of the MEMS sensing module.

In an embodiment of the present invention, the alerting module is integrated into the master controlling device.

In an embodiment of the present invention, the alerting module is integrated into an alerting device, and the master controlling module sends the alerting signal to the alerting module wirelessly or via a wired connection.

The present invention also provides an anti-theft device, including an MEMS sensing module, a master controlling module and an alerting module; wherein the three modules are integrated with each other. The MEMS sensing module is configured for detecting a velocity, an acceleration and/or a spatial location of the MEMS sensing module itself, and transferring the detected velocity, the acceleration or the spatial location of the MEMS sensing module to the master controlling module. The master controlling module is configured for determining whether the MEMS sensing module is disposed within an anti-theft range according to the velocity, the acceleration or the spatial location of the MEMS sensing module as transferred from the MEMS sensing module, and sending an alerting signal to the alerting module once the MEMS sensing module is determined to be disposed outside of the anti-theft range, wherein the anti-theft range is at least one of a velocity range, an acceleration range and a spatial range, or a combination of at least two thereof. The alerting module is configured for performing an alerting action when receiving the alerting signal.

In an embodiment of the present invention, the anti-theft device further includes a latching module. The latching module is configured for receiving an external input of an instruction and setting the anti-theft device into a locked status or an unlocked status according to the instruction. In the locked status, the master controlling module determines whether the MEMS sensing module is disposed within the anti-theft range based on the spatial location of the MEMS sensing module, and send the alerting signal to the alerting module once the MEMS sensing module is determined to be disposed outside of the anti-theft range. Alternatively, in the unlocked status, the master controlling module does not send the alerting signal to the alerting module.

In an embodiment of the present invention, the latching module is configured to switch the anti-theft device from the locked status to the unlocked status when the anti-theft device receives a predetermined encrypted instruction in the locked status.

In an embodiment of the present invention, the master controlling module is configured for storing and defining a velocity, an acceleration and/or a spatial location of the anti-theft range, and determining whether the MEMS sensing module is disposed within the anti-theft range according to the velocity, the acceleration or the spatial location of the anti-theft range and the velocity, the acceleration or the spatial location of the MEMS sensing module.

In an embodiment of the present invention, the anti-theft device further includes a communication module. The master controlling module is configured for receiving a defined velocity, a defined acceleration or a defined spatial location of the anti-theft range via the communication module from an external element.

In an embodiment of the present invention, a current velocity, a current acceleration or a current spatial location of the MEMS sensing module is transferred to the master controlling module when the anti-theft device is disposed at the defined velocity, the defined acceleration or the defined spatial location of the anti-theft range. The master controlling module stores the current velocity, the current acceleration or the current spatial location of the MEMS sensing module as the defined velocity, the defined acceleration or the defined spatial location of the anti-theft range.

In an embodiment of the present invention, the master controlling module includes a storing unit and a determining unit. The storing unit is configured for storing the defined velocity, the defined acceleration or the defined spatial location of the anti-theft range. The determining unit is configured for determining whether the MEMS sensing module is disposed within the anti-theft range according to the defined velocity, the defined acceleration or the defined spatial location of the anti-theft range and the velocity, the acceleration or the spatial location of the MEMS sensing module.

The present invention further provides an anti-theft method. The method includes the steps of: attaching a MEMS device including an MEMS sensing module to an object, so that the MEMS device moves along with the object. The MEMS sensing module is configured to detect a velocity, an acceleration or a spatial location of the MEMS sensing module itself, and transfer the detected velocity, the acceleration or the spatial location of the MEMS sensing module to a master controlling module. The master controlling module is an integrated module inside of the MEMS sensing module or an external module; determining whether the MEMS sensing module is disposed within an anti-theft range by the master controlling module according to the velocity, the acceleration or the spatial location of the MEMS sensing module as transferred from the MEMS sensing module, and sending an alerting signal to the alerting module once the MEMS sensing module is determined to be disposed outside of the anti-theft range, and the anti-theft range is at least one of a velocity range, an acceleration range and a spatial range, or a combination of at least two thereof; and performing an alerting action when the alerting module receives the alerting signal.

In an embodiment of the present invention, the master controlling module is configured to store and define a velocity, an acceleration and a spatial location of the anti-theft range, and determine whether the MEMS sensing module is disposed within the anti-theft range according to the velocity, the acceleration or the spatial location of the anti-theft range and the velocity, the acceleration or the spatial location of the MEMS sensing module.

In an embodiment of the present invention, the master controlling module is configured to receive a defined velocity, a defined acceleration or a defined spatial location of the anti-theft range from an external element.

In an embodiment of the present invention, a current velocity, a current acceleration or a current spatial location of the MEMS sensing module is transferred to the master controlling module when the MEMS sensing module is disposed at the defined velocity, the defined acceleration or the defined spatial location of the anti-theft range. The master controlling module stores the current velocity, the current acceleration or the current spatial location of the MEMS sensing module as the defined velocity, the defined acceleration or the defined spatial location of the anti-theft range.

According to the present invention, a specific anti-theft range can be set by the anti-theft system (or device). The anti-theft range is at least one of a velocity range, a acceleration range and a spatial range, or at least two thereof. Once an object is outside of the anti-theft range, the anti-theft system (or device) would set off an alarm, therefore achieving an anti-theft effect.

According to the present invention, when the anti-theft system (or device) is located within the anti-theft range, all movements of the protected object would not activate the alarm, and thus would not affect the normal usage of the protected object.

According to the present invention, the connection between the anti-theft system (or device) and the protected object is very simple, and complex wiring or configuration is not required. Therefore, the anti-theft system and device of the present invention is easy to use.

BRIEF DESCRIPTION OF THE DRAWINGS

The invention would become more readily apparent to those ordinarily skilled in the art after reviewing the following detailed description and accompanying drawings, in which:

FIGS. 12A through 12D are schematic illustrations depicting the initialization of the portable anti-theft device according to an embodiment of the invention, wherein FIG. 12A is a schematic illustration depicting the initialization of a relative distance, FIG. 12B is a schematic illustration depicting the initialization of a planar range, FIG. 12C is a schematic illustration depicting the initialization of a three-dimensional range and FIG. 12D is a schematic illustration depicting the initialization of a rotational angle.

DETAILED DESCRIPTION OF PREFERRED EMBODIMENTS

Purposes, technical measures and advantages of the present invention would now be described more specifically with reference to the following embodiments, accompanying the illustrated drawings. It is to be noted that the following descriptions of preferred embodiments are presented herein for purpose of illustration and description only. It is not intended to be exhaustive or to be limited to the precise form disclosed.

Generally speaking, the present invention utilizes the velocity and acceleration sensibility and self-locating function of micro electro-mechanical systems (MEMS) to realize anti-theft effects. By attaching the anti-theft device to an object to be protected, the anti-theft device can move along with the protected object, so that the protected object's moving velocity, acceleration or spatial location can be acquired. Once the object's velocity, acceleration or spatial location is determined to fall outside of a predetermined anti-theft secured range, the anti-theft device would perform an alerting action. In the present invention, self-locating refers to the capability to detect a spatial location of the device itself. According to the present invention, the anti-theft range is defined by at least one of a velocity range, an acceleration range and a spatial range, or a combination of at least two thereof.

Figure 1:
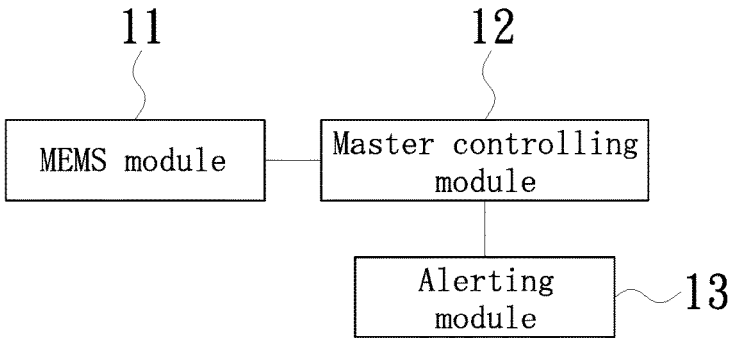
FIG. 1 is a block diagram depicting the basic configuration of an anti-theft system according to the present invention.

FIG. 1 is a block diagram depicting the basic configuration of an anti-theft system according to the present invention. As shown in FIG. 1, the anti-theft system having the aforementioned functions includes at least one MEMS sensing module 11, a master controlling module 12 and an alerting module 13. In the present invention, the "modules" can be implemented by hardware components each with an independent function, or can be implemented by a combination of a plurality of hardware components. On the other hand, different modules can be implemented by a single hardware component with different functions. When different modules are implemented by different components, the components can be connected by any possible manner, for example, by a bus, a wired connection or a wireless connection. The hardware component can be a processor, a sensor and associated circuits. The processor can be a chip or a DSP capable of a specific data processing function, of can be a CPU capable of executing common programs. The sensor can be an integrated sensor or separate sensors.

The MEMS sensing module 11 is capable of detecting a velocity, an acceleration and/or a spatial location of the MEMS sensing module itself, and transferring the detected velocity, the acceleration or the spatial location of the MEMS sensing module to the master controlling module 12. The spatial location refers to a spatial location of the object, and the velocity, the acceleration and the spatial location can be three-dimensional, two-dimensional or one-dimensional. The velocity, the acceleration or the spatial location can be represented by any existing method, for example, by coordinates in a Cartesian rectangular coordinate system or an angular coordinate system. The MEMS sensing module is generally implemented by a MEMS sensor, which is capable of detecting its changes in acceleration and velocity over time with respect to a reference point, and acquiring its spatial location with respect to the reference point based on a time-dependent function of the acceleration and the velocity.

The master controlling module 12 is configured to determine whether the MEMS sensing module 11 is disposed within the anti-theft range according to the velocity, the acceleration or the spatial location of the MEMS sensing module as transferred from the MEMS sensing module 11, and send an alerting signal to the alerting module 13 once the MEMS sensing module 11 is determined to be disposed outside of the anti-theft range. For example, when the velocity of the MEMS sensing module exceeds a threshold velocity value, it is determined that the MEMS sensing module has exceeded the anti-theft range. Moreover, the spatial range can be a spatial range with any arbitrary shape or boundary, such as a three-dimensional spatial range, a two-dimensional spatial range or an one-dimensional spatial range. Generally, once a reference coordinate system is determined, a spatial location may be defined by coordinates in the reference coordinate system. An anti-theft range can thus be defined by more than one (that is, a plurality of) spatial locations. Similarly, the spatial range can also be defined by the Cartesian rectangular coordinate system or the angular coordinate system so as to facilitate calculation and determination; however, such examples are not intended to limit the invention thereto. Thus, once the spatial location of the anti-theft range is acquired, it would be possible to calculate and determine whether the current spatial location is within such spatial range by a calculation algorithm, such as by a boundary calculation method.

According to the present invention, the MEMS sensing module 11 may be a single module or a plurality of modules. If there are more than one MEMS sensing module 11, the modules would operate independently. Further, based on difference setting of the secured range, each MEMS sensing module 11 can correspond to the same anti-theft range or to different anti-theft ranges. Thereafter, the master controlling module receives the velocity, the acceleration or the spatial location of the MEMS sensing module as sent from all MEMS sensing module 11. Once any one of the MEMS sensing modules 11 is detected to be outside of the corresponding anti-theft range, the master controlling module would send an alerting signal to the alerting unit.

Once the alerting module 13 receives the alerting signal, an alerting action would be performed. The alerting action can be any kind of audio alarm, visible alarm, electrical alarm, magnetic alarm, mechanical alarm; and is implemented by any means perceivable by human beings, for example, generating audio sounds or flash lights or activating a protective device. The alerting action can also transfer the alerting signal to another external alerting device. If there are more than one (a plurality of) MEMS sensing modules 11, the master controlling module 12 would send out different alerting signals according to the respective MEMS sensing module 11. Alternatively, If there are more than one (a plurality of) alerting modules 13, the master controlling module 12 would send respective alerting signals to the alerting modules 13 according to the different MEMS sensing modules 11.

Figure 2:
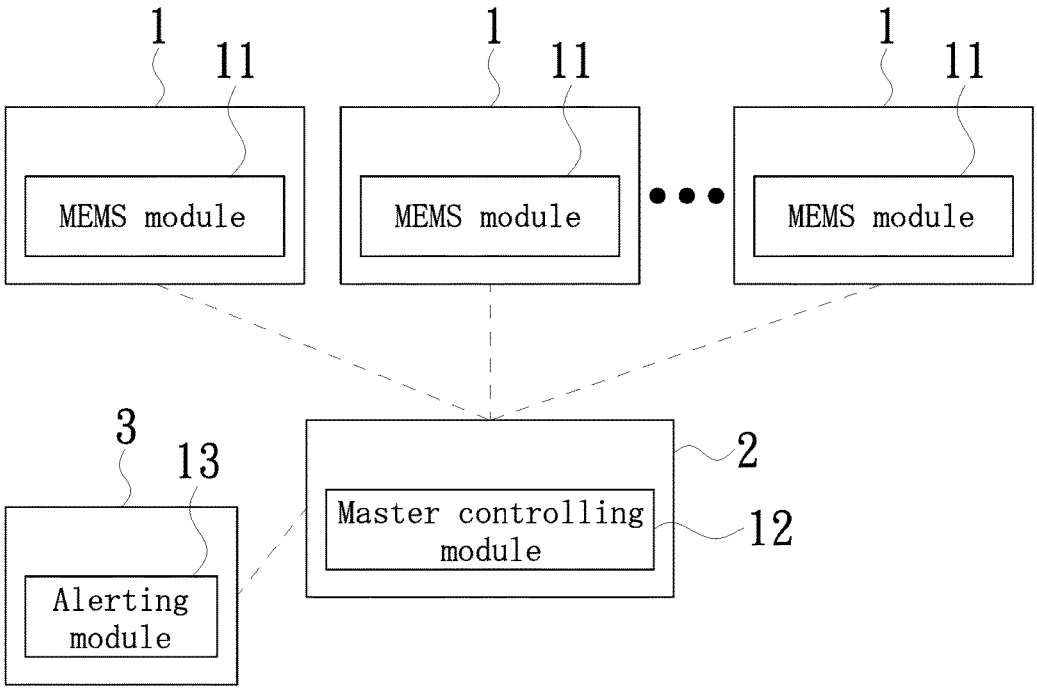
FIG. 2 is a block diagram depicting the configuration of an anti-theft system according to an embodiment of the present invention.

FIG. 2 is a block diagram depicting the configuration of an anti-theft system according to an embodiment of the present invention. As shown in FIG. 2, in this embodiment, more than one (a plurality of) MEMS sensing modules 11, a master controlling module 12 and an alerting module 13 are included. Each of the MEMS sensing module 11 is integrated into a MEMS sensing device 1, the master controlling module 12 is integrated into a master controlling device 2, and each of the MEMS sensing modules 11 communicates with the master controlling module 12 wirelessly. The alerting module 13 is also integrated into an alerting device 3, and the master controlling module 12 sends the alerting signal to the alerting module 13 wirelessly. However, it is not intended to limit the present invention to the above-described communication methods for information-sending and information-receiving, it is also possible to transfer the velocity, the acceleration, the spatial location and the alerting information via a wired connection so as to improve stability and anti-interference of the system.

The configuration of this embodiment allows the alerting device to be mounted at a location convenient for monitoring, and thus extend its alert range broader.

Figure 3:
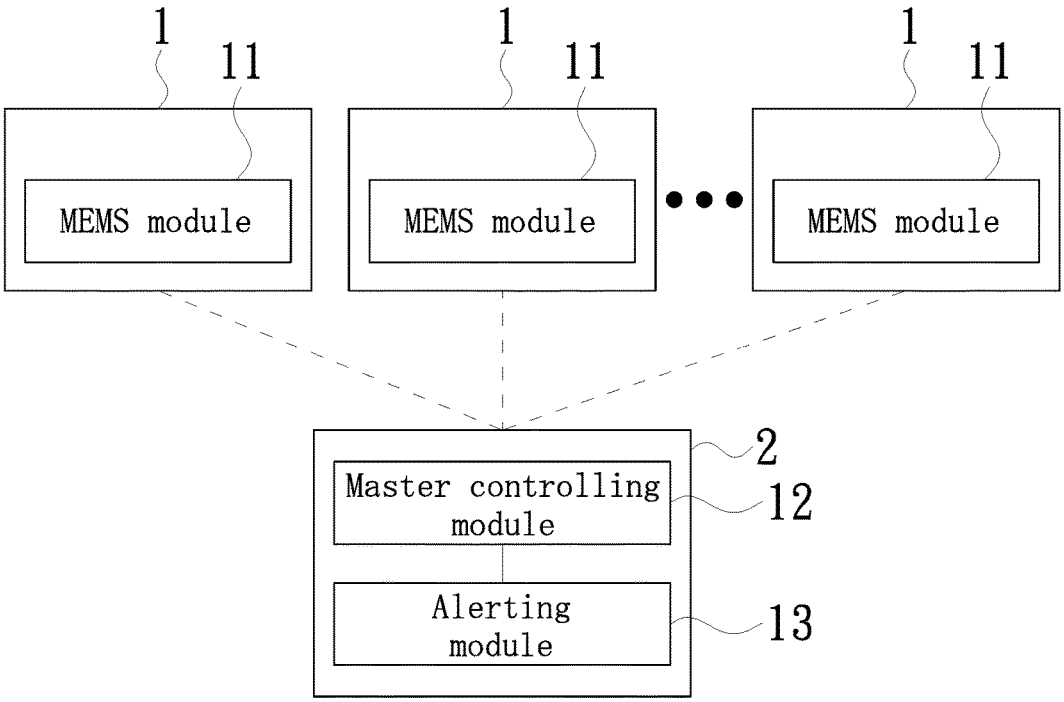
FIG. 3 is a block diagram depicting the configuration of an anti-theft system according to another embodiment of the present invention.

Of course, the alerting module 13 and the master controlling module 12 also can be integrated into a single device, as illustrated by FIG. 3. As shown in FIG. 3, both of the alerting module 13 and the master controlling module 12 are integrated into the master controlling device 2. Advantage of this embodiment is that the master controlling device can be implemented as a portable accessory suitable for security personnel to carry around with, so that pinpoint alerts can be achieved.

Figure 4:
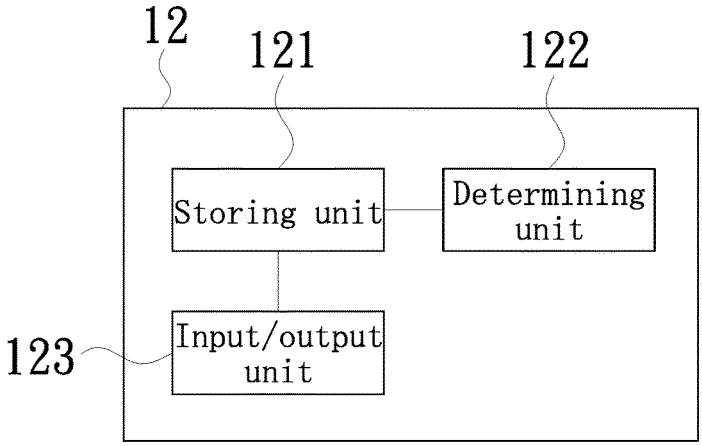
FIG. 4 is a block diagram depicting the configuration of a master controlling module of the anti-theft system according to an embodiment of the present invention.

FIG. 4 is a block diagram depicting the configuration of the master controlling module of the anti-theft system according to an embodiment of the present invention. As shown in FIG. 4, the master controlling module 12 includes at least a storing unit 121 and a determining unit 122. The storing unit 121 is configured for storing the velocity, the acceleration or the spatial location of the anti-theft range, and the determining unit 122 is configured for determining whether the MEMS sensing module is disposed within the anti-theft range according to the velocity, the acceleration or the spatial location of the anti-theft range and the velocity, the acceleration or the spatial location of the MEMS sensing module.

It is possible to acquire the velocity, the acceleration or the spatial location of the anti-theft range as stored in the master controlling module 2 via any arbitrary manner. For example, the master controlling module 12 can further include an input/output unit 123 for a user to directly input the location of the anti-theft range into the storing unit 121. However, in such manner, the user would be required to measure the spatial information in advance and perform an input, causing an increased operational complexity for the user.

In another embodiment of the present invention, the velocity, the acceleration or the spatial location of the anti-theft range can be sent via the MEMS sensing device 1, which includes the MEMS sensing module 11. Since the MEMS sensing module 11 itself is capable of self-detecting velocity and acceleration and self-locating, thus, it is possible to move the MEMS sensing device 1 including the MEMS sensing module 11 at a predetermined velocity in advance, or locate it at locations suitable for defining the spatial range. Thereafter, the acquired velocity, acceleration or spatial location is sent to the master controlling module 12 of the master controlling device 2. That is, when the MEMS sensing module 11 is disposed at the velocity, acceleration or spatial location of the anti-theft range, the current velocity, the current acceleration or the current spatial location of the MEMS sensing module 11 would be sent to the master controlling module 12. Thereafter, the master controlling module 12 would store the received velocity, acceleration or spatial location as the velocity, the acceleration or the spatial location of the anti-theft range. This is suitable for acquiring a spatial location of a specific spatial range, for example, for a rectangular parallelepiped room. The MEMS sensing module 11 would only need to measure the coordinates of the room's eight vertices to acquire and save a rectangular parallelepiped spatial range as defined by the spatial location. The master controlling device 2 would compare the detected spatial location with the anti-theft range as defined by the stored spatial location in real-time, so that it can determine whether the MEMS sensing device 1 is located in the room.

Figure 5:
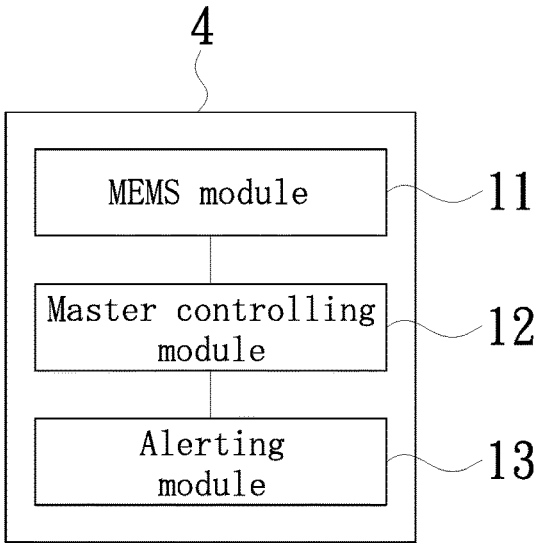
FIG. 5 is a block diagram depicting configuration of an anti-theft system (i.e. a portable integrated anti-theft device) according to another embodiment of the present invention.

FIG. 5 is a block diagram depicting the configuration of an anti-theft system (i.e. a portable integrated anti-theft device) according to another embodiment of the present invention. As shown in FIG. 5, in this embodiment, the MEMS sensing module 11, the master controlling module 12 and the alerting module 13 are integrated into a single device, i.e. the anti-theft device 4 is comprised of the three modules. Similar to the previous embodiment, the MEMS sensing module 11 is configured for detecting the current velocity, acceleration or spatial location of itself, and transferring the detected velocity, acceleration or spatial location to the master controlling module 12. The master controlling module 12 is configured for determining whether the MEMS sensing module 11 is disposed within the anti-theft range based on the velocity, the acceleration or the spatial location of the MEMS sensing module as transferred from the MEMS sensing module 11; and once the MEMS sensing module is detected to be outside of the anti-theft range, the master controlling module 12 would send an alerting signal to the alerting module 13. The alerting module is configured for performing an alerting action when receiving the alerting signal.

In this embodiment, the three modules can be connected with each other via an internal bus or via any electrical connection means, as long as the modules are capable of carrying out information exchange with each other and constituting an integrated unit in its mechanical structure. In this way, the functions of sensing, determining and alerting can be achieved by a single anti-theft device 4, and thus, configuration of the system is simplified and portability of the device is realized.

In this embodiment, each of the modules operates similar to the previous embodiments. To acquire as a defined velocity, acceleration and spatial location the anti-theft range, one would only need to move the anti-theft device 4 at a predetermined velocity and acceleration (generally a maximum value of the predetermined velocity and acceleration) or locate the device 4 at a defined spatial location of the anti-theft range, and then, the current velocity, the current acceleration or the current spatial location of the MEMS sensing module would be sent to the master controlling module 12. The master controlling module 12 would store the received velocity, acceleration or spatial location as the as the defined velocity, the defined acceleration or the defined spatial location of the anti-theft range.

Figure 6:
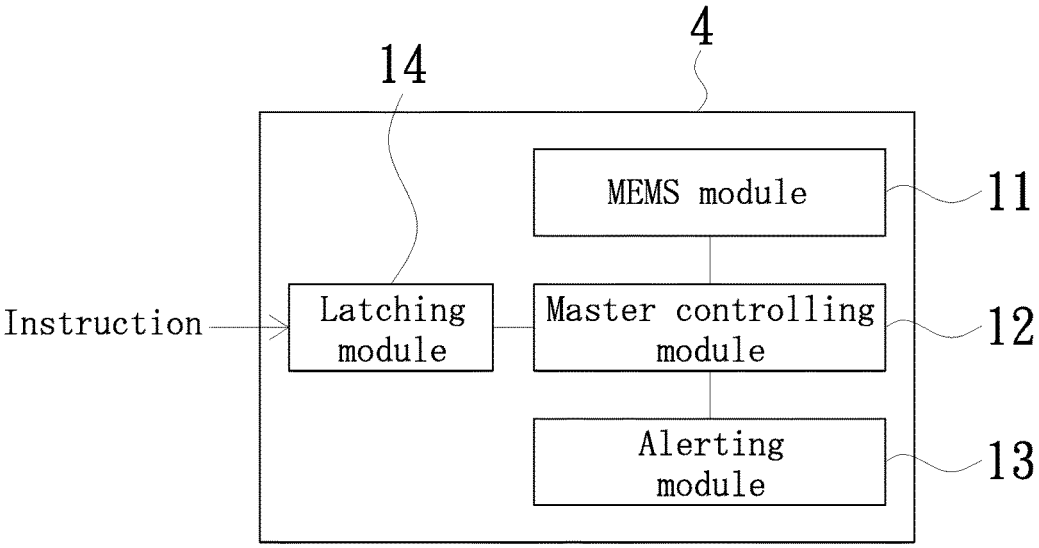
FIG. 6 is a block diagram depicting configuration of a portable integrated anti-theft device according to another embodiment of the present invention.

FIG. 6 is a block diagram depicting the configuration of a portable integrated anti-theft device according to another embodiment of the present invention. As shown in FIG. 6, the difference between this embodiment and the anti-theft device as shown by FIG. 5 lies in that the anti-theft device 4 as shown in FIG. 6 further includes a latching module 14. A function of the latching module 14 is to facilitate the operation of the anti-theft device 4 for the user so as to activate anti-theft function and cancel anti-theft function. Another function of the latching module 14 is to prevent an illegal user from maliciously operating the anti-theft device 4 to break down the anti-theft function.

Specifically, the latching module 14 is configured for receiving an instruction from an external input, and setting the anti-theft device 4 into a locked status or a unlocked status according to the instruction. The locked status refers to the MEMS sensing module 11 performing regular acquisition of velocity, acceleration or spatial location, and the master controlling module 12 performing determining and alerting, therefore activating the anti-theft function. The unlocked status refers to inactivating the alerting and the anti-theft functions and the master controlling module 12 not sending the alerting signal under any situation. Preferably, when the anti-theft device is in the locked status, the latching module 14 would not switch the anti-theft device 4 from the locked status to the unlocked status until receiving a predetermined encrypted instruction. In this way, only the user who controls the encrypted instruction may cancel the anti-theft function, so as to enhance the security of the anti-theft device 4.

Moreover, in comparison with the conventional anti-theft device, which requires an additional unlocking device, such as an unlocking card, the invention can achieve locking and unlocking of the anti-theft device 4 via the latching module 14. That is, the anti-theft device of the present invention can lock or unlock the anti-theft function directly from the device itself, resulting in a simplified device configuration, improved portability and operability for the users.

Figure 7:
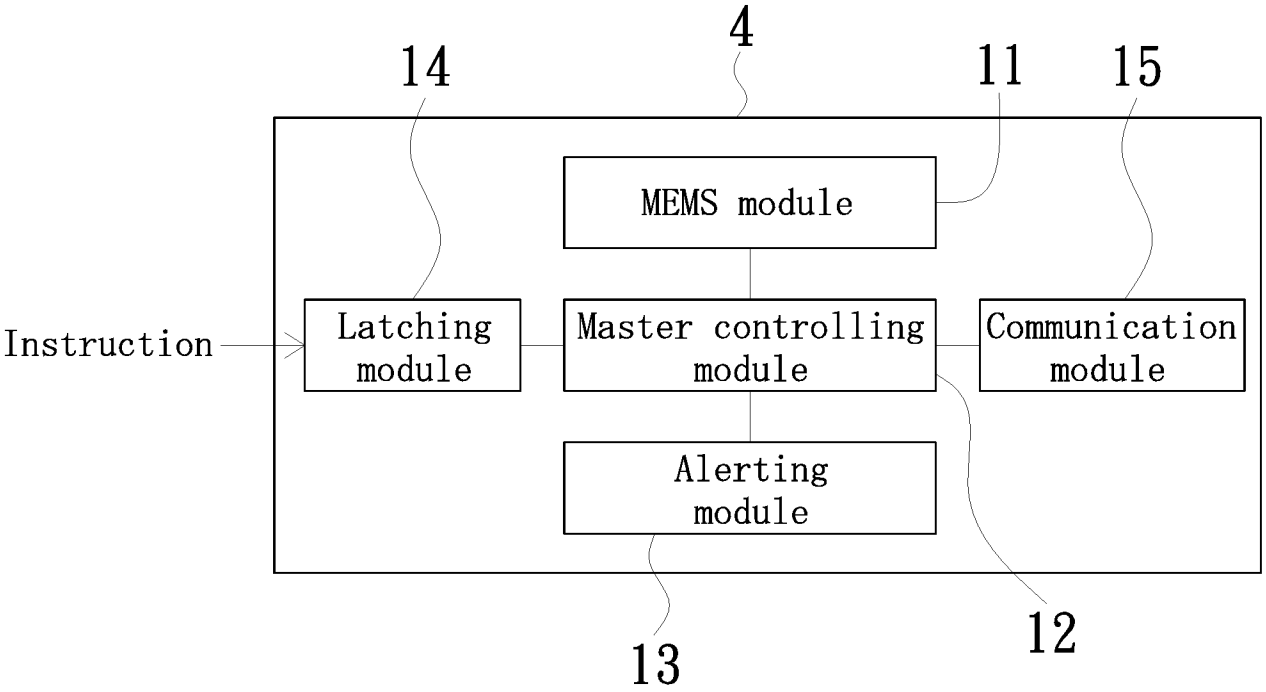
FIG. 7 is a block diagram depicting the configuration of a portable integrated anti-theft device according to an embodiment of the present invention.

FIG. 7 is a block diagram depicting the configuration of a portable integrated anti-theft device according to another embodiment of the present invention. As shown in FIG. 7, the integrated portable anti-theft device further includes a communication module 15. The communication module is configured for receiving an external control information. The control information may include the velocity, the acceleration or the spatial location of the anti-theft range of the anti-theft range, or include an instruction for the latching module, so that the latching module can lock or unlock the integrated anti-theft device according to the instruction. The communication module 15 is generally directly connected to the master controlling module 12, and the master controlling module transfers the information received from the communication module 15 to the corresponding modules. Further, the communication module 15 is further configured for sending information to an external device, for example, sending the current velocity, acceleration or spatial location to the external device, so that the user could manage and monitor the integrated portable anti-theft device's condition via the external device in real-time. The communication module 15 may or may not be connected to the Internet. Data communication may be performed by wired and wireless means, and the wireless mean may include, but is not limited to, NFC (near-distance wireless communication technology), BT (Blue tooth), WIFI (wireless network communication technology), mobile network technology, such as 2G/3G/LTE, FM (frequency modulation technology). For example, data exchange can be carried out under a NFC-aided, Blue tooth-aided, infrared-aided, Wi-Fi-aided condition without the Internet; alternatively, data exchange can be carried out under a 2G/3G/LTE-aided condition with the Internet and other network system. It is not intended to limit the present invention to the above-described means for data communication.

The invention would be described in more details in the following embodiments.

Figure 8:
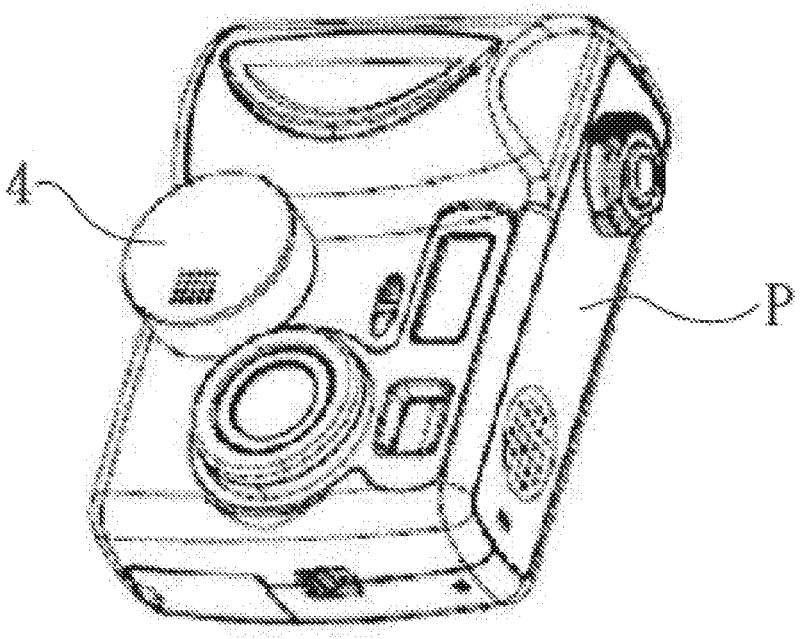
FIG. 8 is a schematic illustration depicting a portable integrated anti-theft device according to an embodiment of the present invention.

FIG. 8 is a schematic illustration depicting a portable integrated anti-theft device according to an embodiment of the present invention. As shown in FIG. 8, an anti-theft device 4 according to this embodiment is applied to the anti-theft protection of a digital camera; that is, the digital camera is regarded as a target object P needed to be protected from theft. In this embodiment, the anti-theft device 4 is employed and directly attached to the object P. Of course, according to another embodiment, it is also possible to mount the anti-theft device 4 to the object or attach the anti-theft device 4 to the object with a rope and lock, as long as the anti-theft device 4 can be moved together with the object P. In addition to electronic equipments, the object to be protected may be, for example, any type of object, pets or even human beings.

Figure 9:
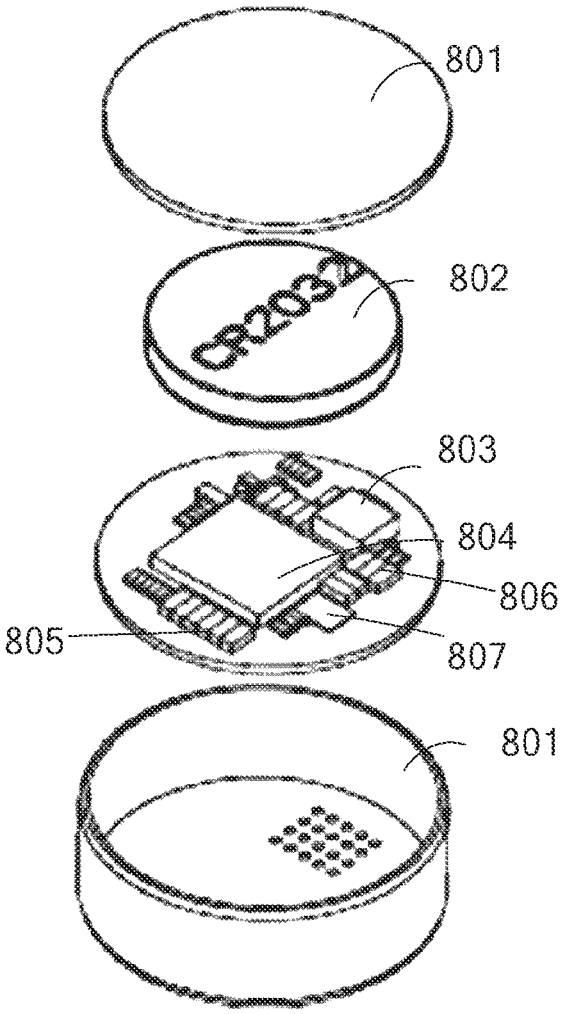
FIG. 9 is a schematic illustration depicting the internal configuration of the portable anti-theft device according to the embodiment as illustrated in FIG. 7.

FIG. 9 is a schematic illustration depicting the internal configuration of a portable anti-theft device according to the previous embodiment. As shown in FIG. 9, the anti-theft device 1 includes a housing 801, a power supply 802, an MEMS detector 803, a master controlling chip 804, a latching controller 805, a communication component 806 and an alarm 807. Here, the MEMS detector 803 functions as the MEMS sensing module 11, the master controlling chip 804 functions as the master controlling module 12, the alarm 807 functions as the alerting module 13, and the latching controller 805 functions as the latching module 14. The communication component 806 functions as the communication module 15 for communicating with an external device, receiving control information sent from the external device or sending the current conditions of the anti-theft device. For example, the received control information may be a password, a setting for the secured range or information for locking or unlocking the device.

The above-described modules and units are all integrated into the housing 801, and the housing 801 is in a flat cylindrical shape. The power supply 802 is configured for supplying power to the anti-theft device 4, and may be any existing type of battery or electric power generating device.

In this embodiment, the MEMS detector 803 is implemented by InvenSense MPU 6050C, the master controlling chip 804 is implemented by Spreadtrum 6530, and the latching controller 805 is implemented by mechanical key switches capable of receiving the user's instructions.

Figure 10:
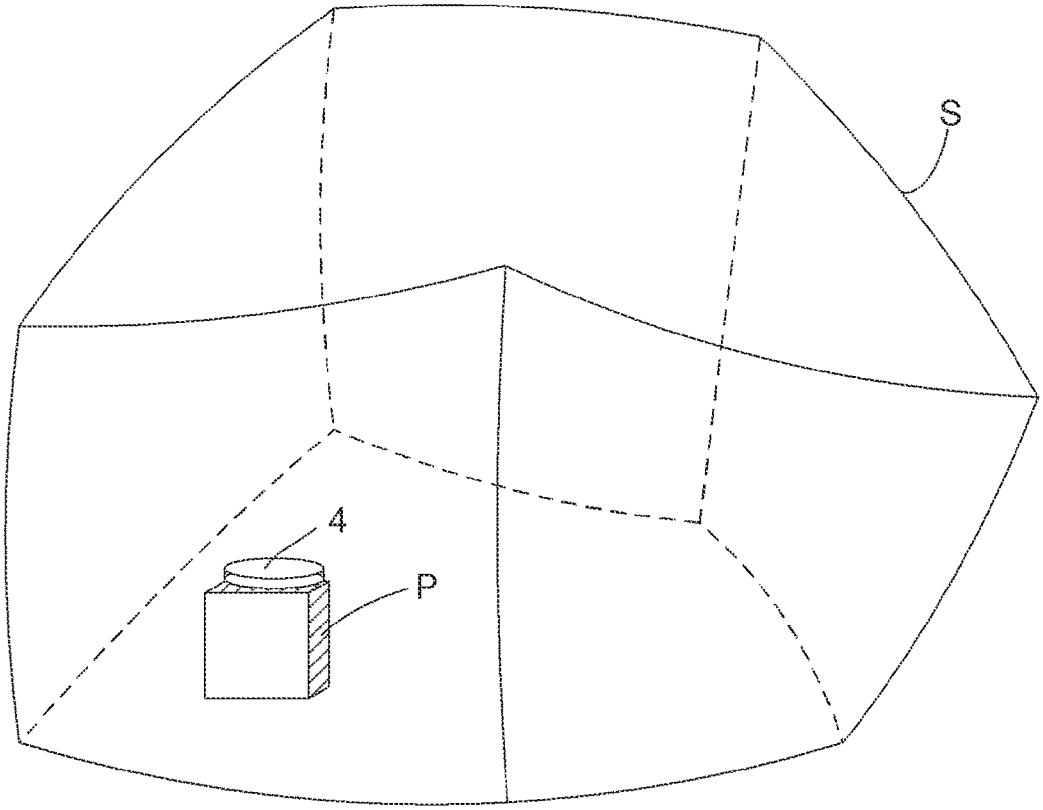
FIG. 10 is a schematic illustration depicting the anti-theft device in use according to the embodiment as illustrated in FIG. 7.

FIG. 10 is a schematic illustration depicting an anti-theft device in use according to the previous embodiment. As long as an object P to be protected locates in a specific spatial range S, it would be determined that the object P is secured. That is, in order to prevent the object P from being carried beyond the spatial range S illegally, an anti-theft device 4 can be attached to the object P. The anti-theft device 4 itself is capable of determining whether it is locating within the spatial range S, and once it is determined that the device 4 has been carried together with the object P and left the spatial range S, the device 4 would perform an alerting action, for example, generating an alerting sound or remotely activating a special security device. Thus, the anti-theft device 4 can caution the object's owner or managing staffs about the potential theft of the object.

Figure 11:
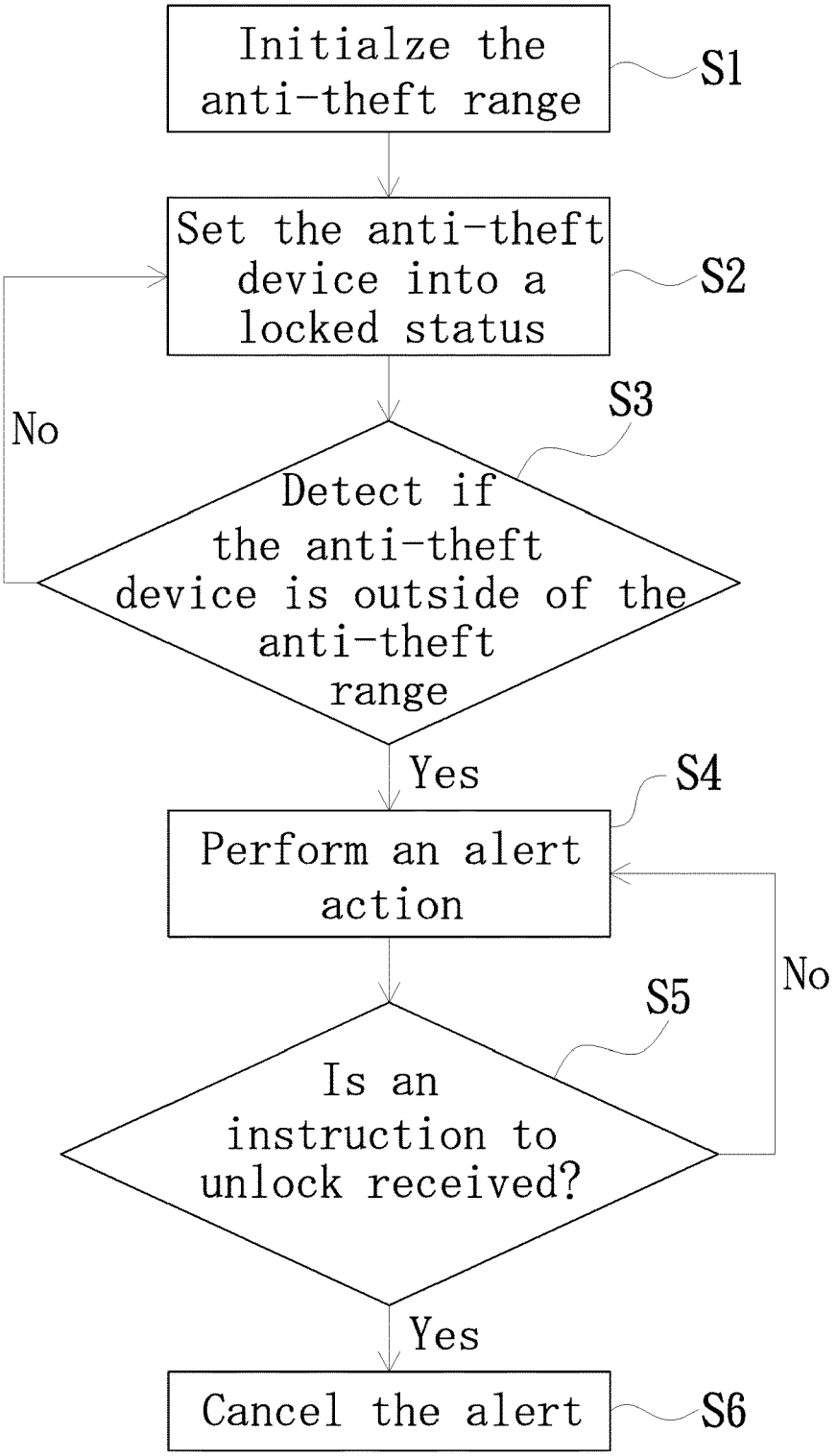
FIG. 11 is a flowchart depicting an operation method of the portable anti-theft device according to the embodiment as illustrated in FIG. 7.

FIG. 11 is a flowchart depicting an operation method of a portable anti-theft device according to the previous embodiment.

S1: Initializing the anti-theft range of the anti-theft device. The anti-theft range can be an arbitrary velocity, acceleration range, or spatial range (i.e. a one-dimensional, two-dimensional or three-dimensional range). According to the present invention, initialization of the portable anti-theft device may be performed by presetting in the anti-theft device or during the use of the anti-theft device (description provided in the following).

S2: Setting the anti-theft device into a locked status. That is, activating an alert mechanism and entering an alert mode. Such a setup can be implemented by an operation of the master controlling chip 804 via the latching controller 805.

S3: Detecting whether the anti-theft device is outside of the anti-theft range. If Yes, proceeding to S4; if No, returning to S2. This step involves detection by the MEMS detector and a calculation and determination by the master controlling chip 804. The step may further include: determining whether anti-theft device is in an unlocked status. If Yes, returning to S2; if No, proceeding to S5. This step is operated by the master controlling chip 804.

S4: The anti-theft device performs an alert. The alert is carried out by the alerting device, and may be an audio or visible alert. Simultaneously, the alerting information may be transferred to another external alerting device, such as a security device.

S5: Determining if an instruction to unlock is received; that is, determining whether the anti-theft device is unlocked. If Yes, proceeding to S7; if No, returning to S5. This step is also operated by the master controlling chip 804.

S6: The anti-theft device cancels the alert. Similarly, the step can be implemented by an operation of the master controlling chip 804 via the latching controller 805.

FIGS. 12A through 12D are schematic illustrations depicting initialization of the anti-theft range of the portable anti-theft device according to previous embodiment. The figures merely exemplify the setup of a spatial location of a specific spatial range. Since the setup of velocity and acceleration range has been described above, detailed descriptions thereof are omitted hereunder.

Figure 12A:
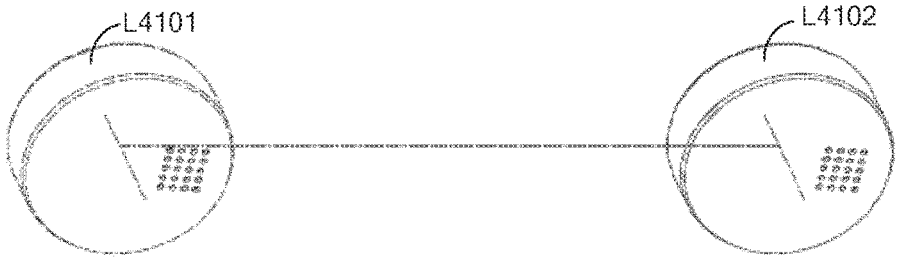

FIG. 12A is a schematic illustration depicting the initialization of the anti-theft range as a secured distance from a central location. The setup process includes: firstly, locating the portable anti-theft device 4 at the central location L4101; at this time, the MEMS detector 803 would send the detected spatial location to the master controlling chip 804 for storing. Then, locating the portable anti-theft device 4 at another location L4102 that is distant away from the central location L4101 for a secured distance; at this time, the MEMS detector 803 would also send the detected spatial location to the master controlling chip 804 for storing. Initialization is so finished. The MEMS detector 803 can receive user's instructions via the latching controller 805 as the latching module 15 or the communication device 806 as the communication module 15. The means for receiving the user's instructions may be a key switch, a touch screen, or any existing wireless communication. For example, the latching controller may include the key switch for receiving the user's input. For example, the communication device may receive control information from an external mobile phone via 3G telecommunication network.

Thus, under the locked status (in an operational condition), the MEMS detector 803 of the portable anti-theft device 4 would detect its current spatial location in real-time and send the location to the master controlling chip 804. Once the master controlling chip is interrupted and leaves beyond the distance from the central location L4101 to the location L4102, an alert status is entered.

Figure 12B:
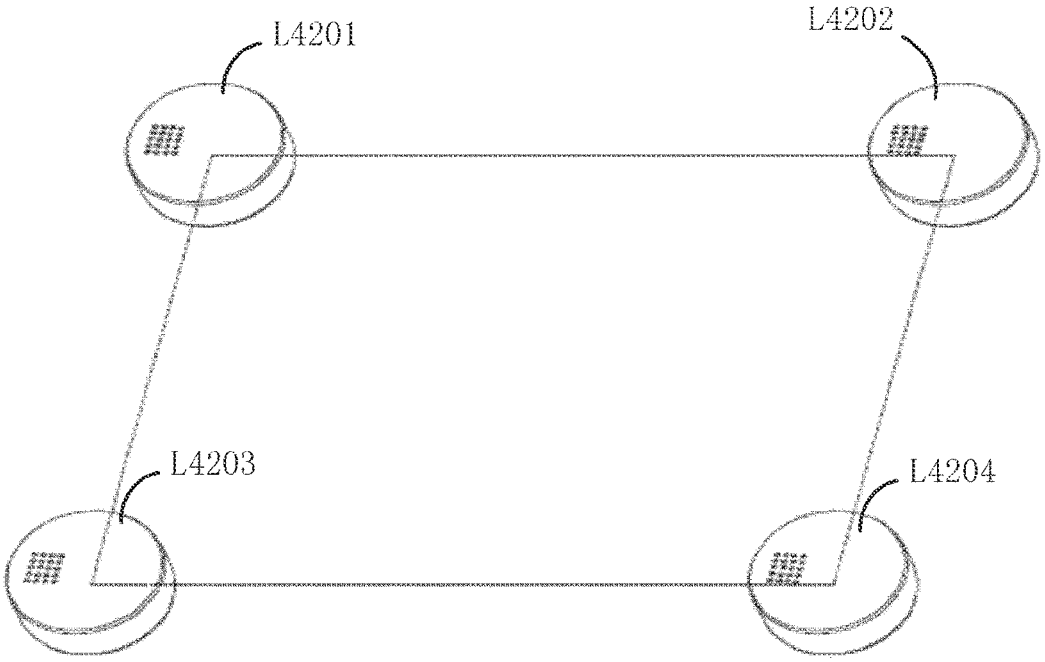

FIG. 12B is a schematic illustration depicting the initialization of the anti-theft range as a planar quadrilateral range or a two-dimensional spatial range. Similar to the processes as shown in FIG. 12A, the setup process includes: firstly, locating the portable anti-theft device at a first location L4201 and sending and storing the spatial location. Next, a second location L4202, a third location L4203 and a fourth location L4204 are stored by a similar manner. The setup is then finished. Once the portable anti-theft device leaves the quadrilateral range as defined by the four locations L4201, L4202, L4203, L4204 as vertices, an alert status is entered. The invention is also applied to initialize any arbitrary polygonal range in a similar manner.

Figure 12C:
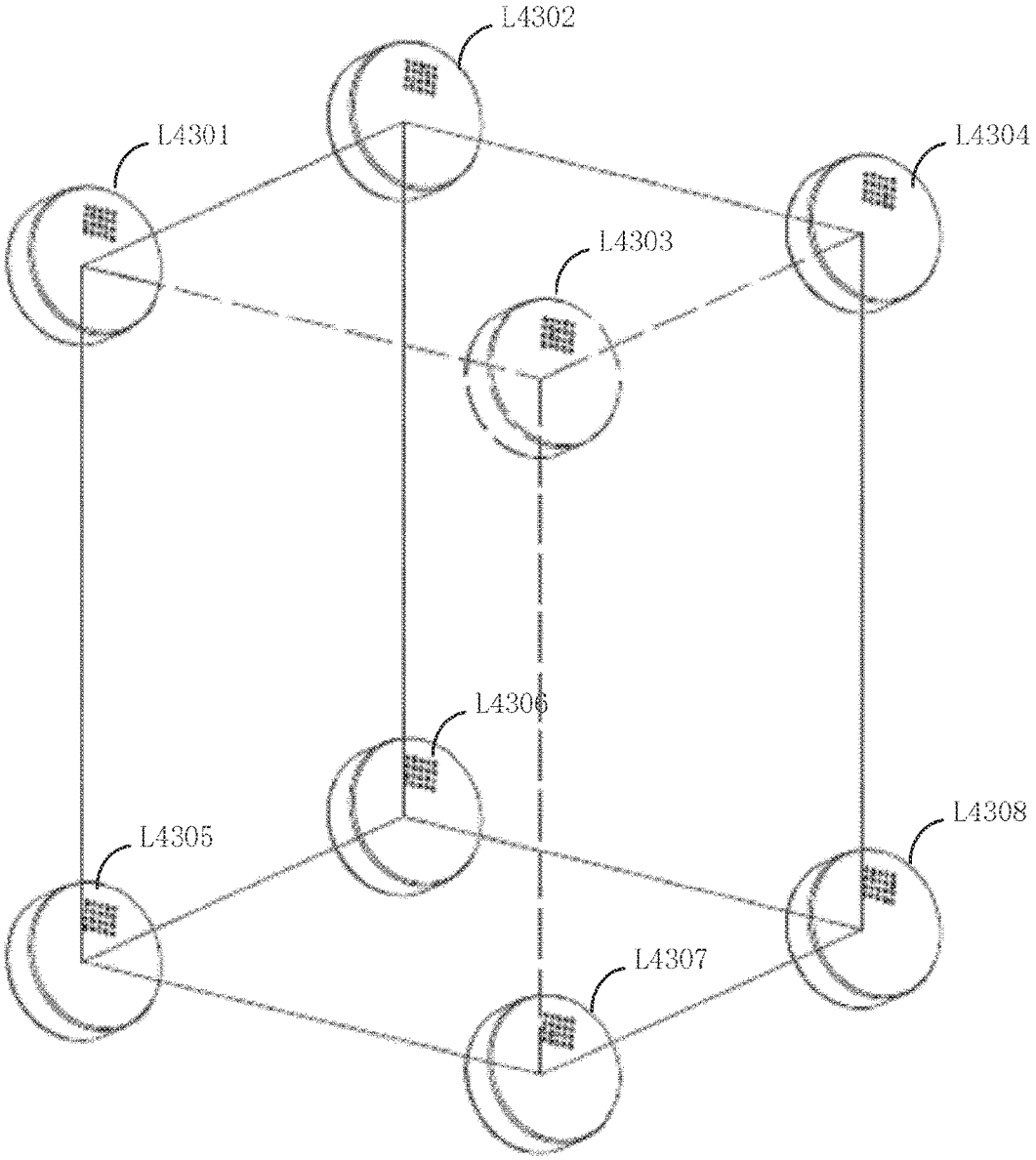

FIG. 12C is a schematic illustration depicting the initialization of the anti-theft range as a three-dimensional spatial range. Similar to the previous embodiment, the setup process includes: sequentially locating the portable anti-theft device 4 at a plurality of three-dimensional spatial location L4301, L4302, L4303, L4304, L4305, L4306, L4307, L4308 so as to complete the initialization. Once the portable anti-theft device leaves the space as defined by L4301, L4302, L4303, L4304, L4305, L4306, L4307, L4308 as vertices, an alert status is entered.

Figure 12D:
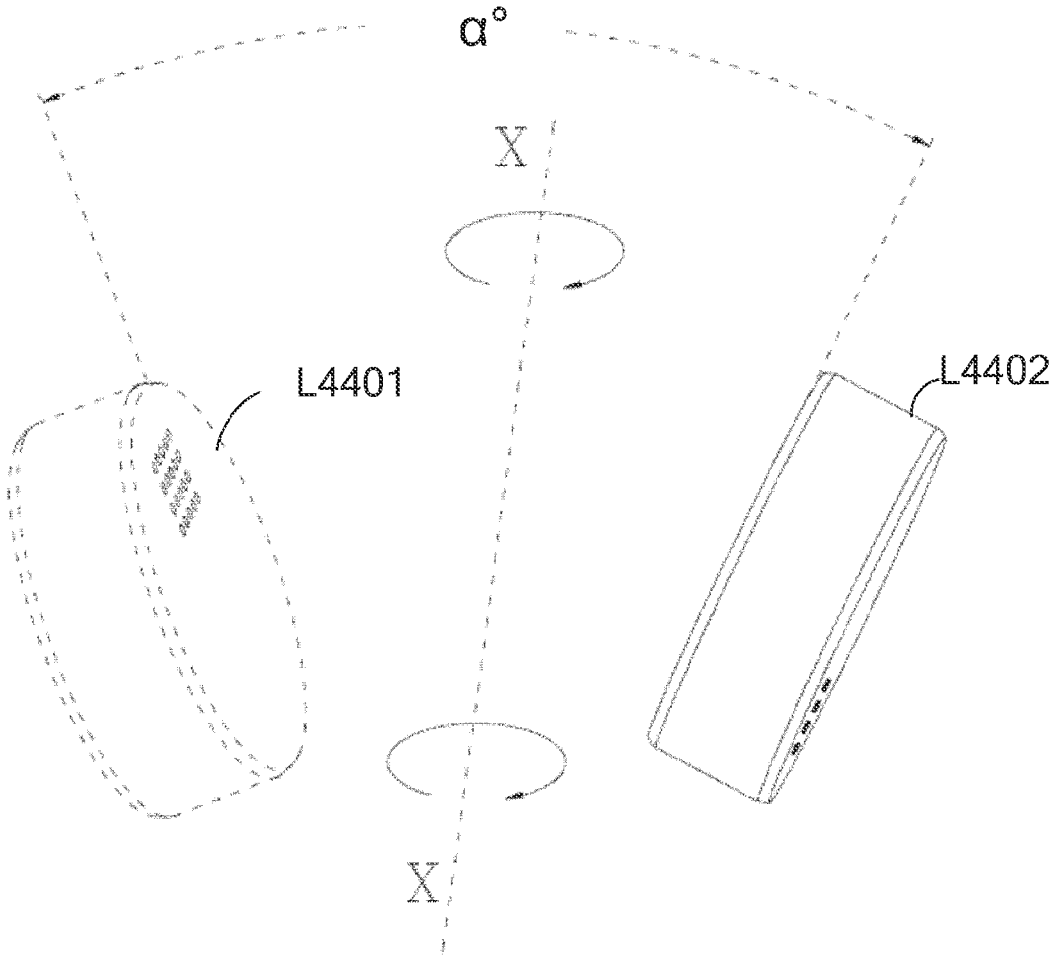

FIG. 12D is a schematic illustration depicting the initialization of the anti-theft range as a three-dimensional angular range. The setup process includes: firstly, locating the portable anti-theft device at a first location L4401 and store the location; then, rotating the portable anti-theft device 4 for $\alpha°$ about an axis X, and locating the device at a second location L4402 and store the location. Once a movement range of the portable anti-theft device exceeds $\alpha°$ while rotating about the axis X, an alert status is entered.

According to the present invention, in addition to the methods of initializing the portable anti-theft device as described above, it is also possible to preset the portable anti-theft device via an internal adjustment; for example, it is possible to setup a default velocity and activate the alert status once the velocity becomes greater or slower than the default velocity. Moreover, it is also possible to setup a default acceleration and activate an alert status once the acceleration becomes greater or slower than the default acceleration.

While the disclosure has been described in terms of what is presently considered to be the most practical and specific embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An anti-theft system, comprising at least one micro electro-mechanical system (MEMS) sensing module, a master controlling module and at least one alerting module, wherein the MEMS sensing module is configured for detecting a velocity, an acceleration, or at least two of the velocity, the acceleration and a spatial location of the MEMS sensing module, and transferring the velocity, the acceleration, or the at least two of the velocity, the acceleration and the spatial location of the MEMS sensing module to the master controlling module, the master controlling module is configured for determining whether the MEMS sensing module is disposed within an anti-theft range according to the velocity, the acceleration, or the at least two of the velocity, the acceleration and the spatial location of the MEMS sensing module as transferred only from the MEMS sensing module, and sending an alerting signal to the alerting module once the MEMS sensing module is determined to be disposed outside of the anti-theft range, and the anti-theft range is a velocity range, an acceleration range or a combination of at least two of the velocity range, the acceleration range and a spatial range, the alerting module is configured for performing an alerting action when receiving the alerting signal, and the MEMS sensing module is directly attached to a protected object so that the MEMS sensing module moves along with the protected object, wherein each of the at least one MEMS sensing module is integrated into a MEMS sensing device, the master controlling module is integrated into a master controlling device, and each of the at least one MEMS sensing module communicates with the master controlling module wirelessly, the master controlling module is configured for storing and defining at least one of a velocity, an acceleration and the spatial location of the anti-theft range, and determining whether the MEMS sensing module is disposed within the anti-theft range according to the velocity, the acceleration or the spatial location of the anti-theft range and the velocity, the acceleration or the spatial location of the MEMS sensing module, the master controlling module is configured for receiving a defined velocity, a defined acceleration or a defined spatial location of the anti-theft range from an external element, and a current velocity, a current acceleration or a current spatial location of the MEMS sensing module is transferred to the master controlling module when the MEMS sensing module is disposed at the defined velocity, the defined acceleration or the defined spatial location of the anti-theft range, and the master controlling module stores the current velocity, the current acceleration or the current spatial location of the MEMS sensing module as the defined velocity, the defined acceleration or the defined spatial location of the anti-theft range.

2. The anti-theft system according to claim 1, wherein the master controlling module comprises a storing unit and a determining unit, the storing unit is configured for storing the defined velocity, the defined acceleration or the defined spatial location of the anti-theft range, and the determining unit is configured for determining whether the MEMS sensing module is disposed within the anti-theft range according to the defined velocity, the defined acceleration or the defined spatial location of the anti-theft range and the velocity, the acceleration or the spatial location of the MEMS sensing module.

3. The anti-theft system according to claim 1, wherein the alerting module is integrated into the master controlling device.

4. The anti-theft system according to claim 1, wherein the alerting module is integrated into an alerting device, and the master controlling module sends the alerting signal to the alerting module wirelessly or via a wired connection.

5. An anti-theft device, comprising at least one micro electro-mechanical system (MEMS) sensing module, a master controlling module and an alerting module, wherein the MEMS sensing module, the master controlling module and the alerting module are integrated with each other, the MEMS sensing module is configured for detecting a velocity, an acceleration, or at least two of the velocity, the acceleration and a spatial location of the MEMS sensing module, and transferring the velocity, the acceleration, or the at least two of the velocity, the acceleration and the spatial location to the master controlling module, the master controlling module is configured for determining whether the MEMS sensing module is disposed within an anti-theft range according to the velocity, the acceleration, or the at least two of the velocity, the acceleration and the spatial location of the MEMS sensing module as transferred only from the MEMS sensing module, and sending an alerting signal to the alerting module once the MEMS sensing module is determined to be disposed outside of the anti-theft range, and the anti-theft range is a velocity range, an acceleration range or a combination of at least two of the velocity range, the acceleration range and a spatial range, the alerting module is configured for performing an alerting action when receiving the alerting signal, and the MEMS sensing module is directly attached to a protected object so that the MEMS sensing module moves along with the protected object, wherein the master controlling module comprises a storing unit and a determining unit, the storing unit is configured for storing the defined velocity, the defined acceleration or the defined spatial location of the anti-theft range, and the determining unit is configured for determining whether the MEMS sensing module is disposed within the anti-theft range according to the defined velocity, the defined acceleration or the defined spatial location of the anti-theft range and the velocity, the acceleration or the spatial location of the MEMS sensing module.

6. The anti-theft device according to claim 5, further comprising a latching module configured for receiving an external input of an instruction and setting the anti-theft device into a locked status or an unlocked status according to the instruction, wherein in the locked status, the master controlling module determines whether the MEMS sensing module is disposed within the anti-theft range based on the spatial location of the MEMS sensing module, and sends the alerting signal to the alerting module once the MEMS sensing module is determined to be disposed outside of the anti-theft range, and in the unlocked status, the master controlling module does not send the alerting signal to the alerting module.

7. The anti-theft device according to claim 6, wherein the latching module is configured to switch the anti-theft device from the locked status to the unlocked status when the anti-theft device receives a predetermined encrypted instruction in the locked status.

8. The anti-theft device according to claim 5, wherein the master controlling module is configured for storing and defining at least one of a velocity, an acceleration and a spatial location of the anti-theft range, and determining whether the MEMS sensing module is disposed within the anti-theft range according to the velocity, the acceleration or the spatial location of the anti-theft range and the velocity, the acceleration or the spatial location of the MEMS sensing module.

9. The anti-theft device according to claim 8, further comprising a communication module, wherein the master controlling module is configured for receiving a defined velocity, a defined acceleration or a defined spatial location of the anti-theft range via the communication module from an external element.

10. The anti-theft device according to claim 9, wherein a current velocity, a current acceleration or a current spatial location of the MEMS sensing module is transferred to the master controlling module when the anti-theft device is disposed at the defined velocity, the defined acceleration or the defined spatial location of the anti-theft range, and the master controlling module stores the current velocity, the current acceleration or the current spatial location of the MEMS sensing module as the defined velocity, the defined acceleration or the defined spatial location of the anti-theft range.

11. An anti-theft method, comprising steps of:

attaching a micro electro-mechanical system (MEMS) device comprising an MEMS sensing module to an object, so that the MEMS device moves along with the object, wherein the MEMS sensing module is configured to detect a velocity, an acceleration or at least two of the velocity, the acceleration and a spatial location of the MEMS sensing module, and transfer the velocity, the acceleration or the at least two of the velocity, the acceleration and the spatial location of the MEMS sensing module to a master controlling module, and the master controlling module is an integrated module inside of the MEMS sensing module or an external module;

determining whether the MEMS sensing module is disposed within an anti-theft range by the master controlling module according to the velocity, the acceleration or the at least two of the velocity, the acceleration and the spatial location of the MEMS sensing module as transferred only from the MEMS sensing module, and sending an alerting signal to the alerting module once the MEMS sensing module is determined to be disposed outside of the anti-theft range, and the anti-theft range is a velocity range, an acceleration range or a combination of at least two of the velocity range, the acceleration range and a spatial range; and performing an alerting action when the alerting module receives the alerting signal, wherein the master controlling module in configured to store and define at least one of a velocity, an acceleration and a spatial location of the anti-theft range, and determine whether the MEMS sensing module is disposed within the anti-theft range according to the velocity, the acceleration or the spatial location of the anti-theft range and the velocity, the acceleration or the spatial location of the MEMS sensing module;

the master controlling module is configured to receive a defined velocity, a defined acceleration or a defined spatial location of the anti-theft range from an external element; and a current velocity, a current acceleration or a current spatial location of the MEMS sensing module is transferred to the master controlling module when the MEMS sensing module is disposed at the defined velocity, the defined acceleration or the defined spatial location of the anti-theft range, and the master controlling module stores the current velocity, the current acceleration or the current spatial location of the MEMS sensing module as the defined velocity, the defined acceleration or the defined spatial location of the anti-theft range.

* * * * *